US008970650B2

(12) United States Patent
Iwamoto

(10) Patent No.: US 8,970,650 B2
(45) Date of Patent: Mar. 3, 2015

(54) IMAGE FORMING APPARATUS WITH BEAM SPLITTER AND APERTURE POSITIONED FOR COMPACTNESS

(71) Applicant: Canon Kabushiki Kaisha, Tokyo (JP)

(72) Inventor: Kazuyuki Iwamoto, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/856,878

(22) Filed: Apr. 4, 2013

(65) Prior Publication Data

US 2013/0286141 A1 Oct. 31, 2013

(30) Foreign Application Priority Data

Apr. 25, 2012 (JP) ..... 2012-100095
Mar. 21, 2013 (JP) ..... 2013-058260

(51) Int. Cl.
*B41J 15/14* (2006.01)
*B41J 27/00* (2006.01)
*G03G 15/043* (2006.01)

(52) U.S. Cl.
CPC ..... *G03G 15/043* (2013.01); *G03G 15/0435* (2013.01)
USPC ..... 347/241; 347/256

(58) Field of Classification Search
USPC ..... 347/231, 236, 241–246, 256–261
See application file for complete search history.

(56) References Cited

U.S. PATENT DOCUMENTS 5,432,537 A * 7/1995 Imakawa et al. ..... 347/135
7,321,380 B2 1/2008 Iwamoto ..... 347/244
7,446,794 B2 11/2008 Iwamoto ..... 347/241
7,471,307 B2 12/2008 Iwamoto ..... 347/234
7,518,627 B2 4/2009 Iwamoto ..... 347/238
7,894,114 B2 * 2/2011 Urakawa et al. ..... 359/205.1
8,085,457 B2 * 12/2011 Ichii et al. ..... 359/212.1

(Continued)

FOREIGN PATENT DOCUMENTS

CN 101211010 7/2008
CN 101295073 10/2008
JP 2002-040350 2/2002
JP 2003-287699 10/2003
JP 2006-259098 9/2006

OTHER PUBLICATIONS

Chinese Office Action dated Dec. 3, 2014 in counterpart Chinese Patent Application No. 201310146512.4, together with an English language translation.

*Primary Examiner* — Hai C Pham
(74) *Attorney, Agent, or Firm* — Fitzpatrick, Cella, Harper & Scinto

(57) ABSTRACT

An image forming apparatus is provided that reduces main scanning jitter with a simple configuration and performs light amount control with high accuracy. The image forming apparatus includes: a laser emitting luminous flux; a main-scanning aperture portion shaping the luminous flux; a beam splitter splitting the luminous flux passed through the main-scanning aperture portion into a reflected beam and a transmitted beam; a rotary polygon mirror deflecting the transmitted beam so that the transmitted beam scans the surface of a photosensitive drum; and an optical box in which the laser, the main-scanning aperture portion, the beam splitter and the rotary polygon mirror are disposed. The main-scanning aperture portion is disposed so as not to block a deflected and transmitted beam. The beam splitter abuts against the main-scanning aperture portion so as not to block a deflected and transmitted beam deflected, and is positioned by abutting against the main-scanning aperture portion.

19 Claims, 6 Drawing Sheets

(56) References Cited

U.S. PATENT DOCUMENTS

2006/0209372 A1* 9/2006 Tada ..... 359/196
2007/0146473 A1* 6/2007 Masuda ..... 347/246
2008/0151326 A1 6/2008 Shimomura ..... 358/474
2008/0218829 A1 9/2008 Nakamura ..... 359/223

* cited by examiner

IMAGE FORMING APPARATUS WITH BEAM SPLITTER AND APERTURE POSITIONED FOR COMPACTNESS

BACKGROUND OF THE INVENTION

1. Field of the Invention

The present invention relates to an image forming apparatus such as a copier or a printer that uses an electrophotographic method and includes an optical scanning apparatus that performs optical writing with respect to a photosensitive member.

2. Description of the Related Art

Normally, an image output portion of an image forming apparatus such as a copier or a printer that uses an electrophotographic method carries out image formation by an electrophotographic process that forms a toner image by scanning the surface of a photosensitive member with a laser beam that flickers in accordance with print data, and developing an electrostatic latent image formed on the photosensitive member. In general, an optical scanning apparatus is used for scanning a photosensitive member with a laser beam. An optical scanning apparatus converts luminous flux from a semiconductor laser that is a light source into substantially parallel luminous flux, deflects the luminous flux using a rotating polygonal mirror that rotates, and thereafter causes the luminous flux to imaged in the form of a spot on a photosensitive member through an element of an imaging optical system such as a lens or a mirror.

In the following description, the term "main-scanning direction" refers to a direction that is perpendicular to a rotation axis of a rotary polygon mirror and an optical axis of an imaging optical system (direction in which a laser beam deflected by the rotary polygon mirror scans a photosensitive member). The term "sub-scanning direction" corresponds to a direction that is parallel to the rotation axis of the rotary polygon mirror or a rotational direction of a photosensitive member. The term "main-scanning cross section" refers to a plane that includes the main-scanning direction and the optical axis of the imaging optical system. The term "sub-scanning cross section" refers to a cross section that is perpendicular to the main-scanning cross section.

In recent years, in response to demands to increase the speed of image formation, image forming apparatuses are known that use a light source that emits a plurality of laser beams in an optical scanning apparatus. In particular, since a vertical cavity surface emitting laser (hereunder, referred to as "VCSEL") facilitates formation of a large number of light emitting points into an array, a large number of optical scanning apparatuses that use a VCSEL have been proposed.

The aforementioned kinds of optical scanning apparatuses have a configuration that controls a light amount of a laser beam that is emitted from a VCSEL. Unlike an edge emitting laser, the emission direction of laser beams emitted from a VCSEL is a single direction. As a configuration for detecting the light amount of a laser beam emitted from the VCSEL, a configuration is known that splits a laser beam emitted from the VCSEL into a plurality of laser beams using a beam splitter or the like that is disposed between the VCSEL and a rotary polygon mirror, and in which an optical sensor receives a laser beam obtained by the aforementioned splitting of the laser beam by the beam splitter. The image forming apparatus controls the light amount of a laser beam that the VCSEL emits based on the light amount of the laser beam received by the optical sensor.

A VCSEL has a characteristic such that a spreading angle (FFP) of a laser beam emitted from the VCSEL changes with a change in the driving current. Therefore, if an aperture is provided between a beam splitter and a rotary polygon mirror, a ratio between a light amount of a laser beam obtained when a laser beam is split by a beam splitter that is detected using an optical sensor and a light amount of a laser beam that passes through the aperture and is irradiated onto the photosensitive member changes, and highly accurate light amount control cannot be performed.

For example, in Japanese Patent Application Laid-Open No. 2002-040350, an optical scanning apparatus is proposed that, after shaping a laser beam using an aperture, splits the light beam with a beam splitter and guides a laser beam obtained by the aforementioned splitting to an optical sensor to detect the light amount. According to this configuration, even if a spreading angle at which light is emitted changes due to a change in the driving current, because the laser beam is split at the beam splitter after the laser beam has been shaped by the aperture, a ratio between a light amount that is reflected by the beam splitter and detected by the optical sensor and a light amount that arrives at the photosensitive member is constant. As a result, light amount control can be performed with high accuracy.

For example, in Japanese Patent Application Laid-Open No. 2006-259098, an optical scanning apparatus is proposed in which an aperture and a beam splitter are integrally formed with each other. According to this configuration, a risk of the positional relationship between the aperture and the beam splitter changing is eliminated, and the positional accuracy can be improved and the number of components can be reduced.

It is known that in an image forming apparatus that forms an electrostatic latent image on a photosensitive member using a plurality of laser beams, the imaging positions of respective laser beams on the photosensitive member deviate in the main-scanning direction, and main scanning jitter arises whereby the amount of deviation thereof differs according to a position in the main-scanning direction. FIG. 6 is a configuration example of a multi-beam scanning system in which two light emitting portions A and B (hereunder referred to as "A laser" and "B laser") are disposed so as to incline at an angle δ with respect to the main-scanning direction. FIG. 7A shows a state in which light beams emitted from the A laser and the B laser that are the two light emitting portions shown in FIG. 6 image spot images on a photosensitive member, in which a beam from the A laser is indicated by a solid line and a beam from the B laser is indicated by an alternate long and short dash line. In FIG. 7A, the beams emitted from the A laser and the B laser that are light emitting portions intersect at an aperture 207 and are incident on a rotary polygon mirror 210 at points that are separated by a deflection point interval L2. After being deflected by the rotary polygon mirror 210, the beams emitted from the A laser and B laser pass through imaging lenses 221 and 222 and image spot images at positions that are separated from each other in the main-scanning direction on the photosensitive member 82. As shown in FIG. 7A, misalignments La, Lb and Lc in the main-scanning direction arise at the spot images that are imaged on the photosensitive drum 82 by the respective beams emitted from the A laser and B laser. It is possible to correct the misalignments in the main-scanning direction on the photosensitive member 82 by altering the light-emitting timing of the A laser and B laser. However, since the misalignment intervals La, Lb and Lc differ respectively depending on the respective positions in the main-scanning direction (in FIG. 7A, the interval Lb is larger than the interval Lc, and the interval La is larger than the interval Lb), it is not possible to correct all of the misalignments at the same time, and therefore main scanning jitter occurs.

If the photosensitive member 82 has an eccentric component, in some cases the photosensitive member 82 becomes decentered during rotation and moves from a position 82 indicated by a solid line to a position 82' indicated by a dashed line. The misalignment amount in the main-scanning direction in this case is, for example, an interval La' at the position corresponding to the interval La, and thus the misalignment amount increases relative to the interval La that is the misalignment amount when there is no decentering.

FIG. 7B illustrates the relationship between a distance from the rotary polygon mirror 210 to the aperture 207 and a deflection point interval on the rotary polygon mirror in a state where the distances between the rotary polygon mirror 210 and the A laser and B laser are fixed. On the left side in FIG. 7B, reference characters Ls denote a distance from the rotary polygon mirror 210 to the aperture 207, and on the right side in FIG. 7B, reference characters Ls' denote a distance from the rotary polygon mirror 210 to the aperture 207. In this case the distance Ls is smaller than the distance Ls'. As shown in FIG. 7B, when the distance from the rotary polygon mirror 210 to the aperture 207 changes to the distance Ls' from the distance Ls, the deflection point interval at the rotary polygon mirror 210 widens from the deflection point interval L2 to a deflection point interval L2'. To reduce main scanning jitter, it is necessary to reduce the deflection point interval L2 at the rotary polygon mirror 210 by decreasing a crossing angle that is formed by the beams of the A laser and B laser at the aperture 207. To achieve this, it is effective to bring the aperture 207 as close as possible to the rotary polygon mirror 210.

SUMMARY OF THE INVENTION

The present invention has been conceived on the basis of the above described situation, and an object to the present invention is to provide an image forming apparatus that reduces main scanning jitter with a simple configuration and performs highly accurate light amount control.

To solve the above described problems, an image forming apparatus according to the present invention includes: a light source configured to emit a laser beam; an aperture configured to shape the laser beam that is emitted from the light source; a beam splitter configured to split the laser beam into a first laser beam that is a reflected beam and a second laser beam that is a transmitted beam; a deflection unit configured to deflect the second laser beam so that the second laser beam deflected scans a photosensitive member; a lens configured to guide the second laser beam deflected by the deflection unit to the photosensitive member, wherein the lens is disposed at a closest position to the deflection unit in a plurality of optical elements, which includes the lens, on an optical path of the second laser beam deflected by the deflection unit; a light-receiving unit configured to receive the first laser beam; and a control unit configured to control a light amount of the laser beam that the light source emits based on a light amount of the first laser beam received by the light-receiving unit; wherein the aperture is provided between a scanning region of the second laser beam deflected by the deflection unit between the deflection unit and the lens, and the light-receiving unit; and wherein the beam splitter is disposed between the deflection unit and the aperture and is positioned by abutting against the aperture.

According to the image forming apparatus of the present invention, main scanning jitter can be reduced with a simple configuration, and highly accurate light amount control can be performed.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

[Exemplary Embodiment]

[Overview of Image Forming Apparatus]

Figure 1A:
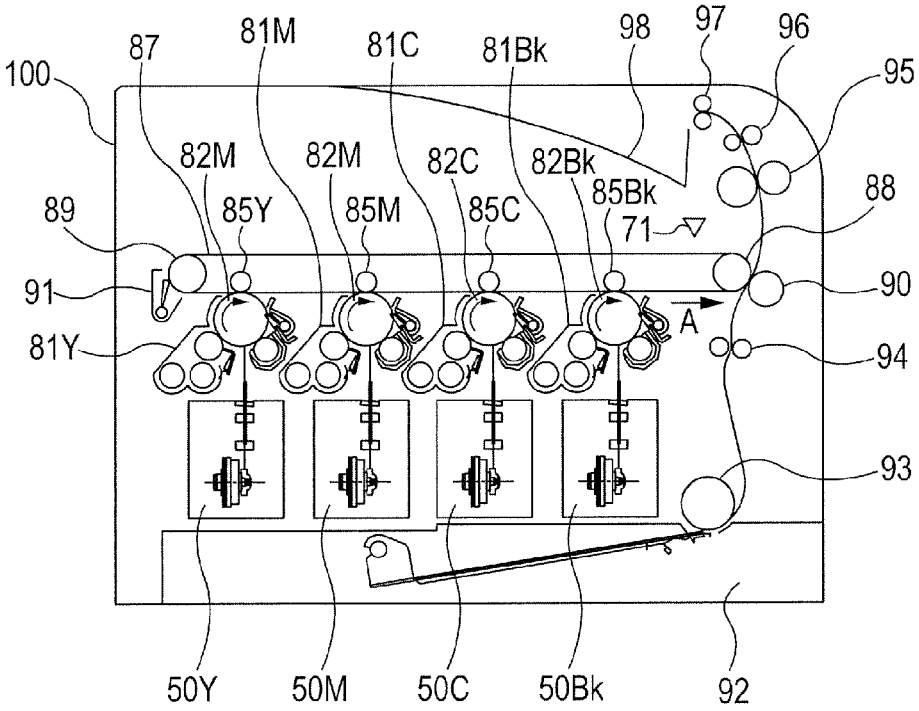
FIG. 1A is a cross-sectional view of an image forming apparatus according to an exemplary embodiment.
Figure 1B:
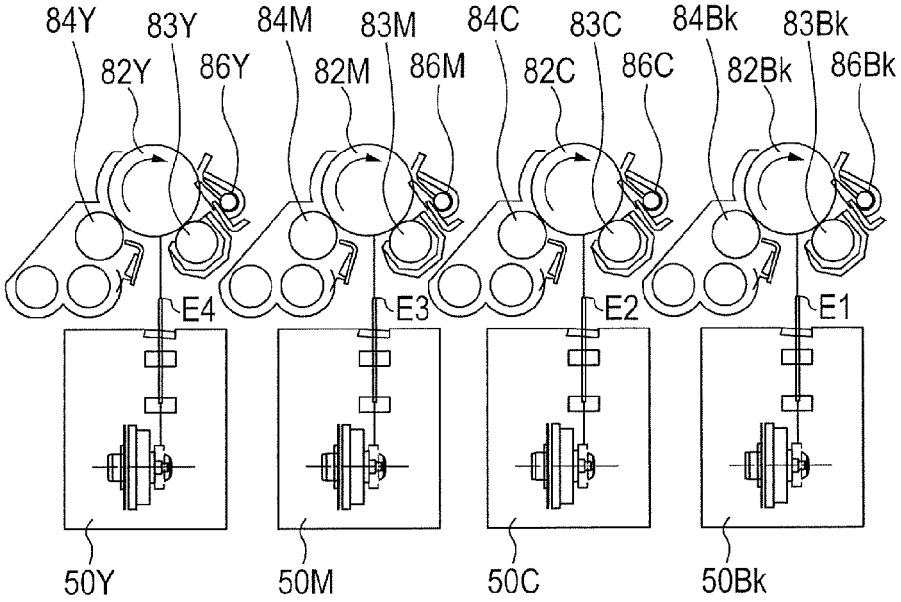
FIG. 1B is a cross-sectional view of optical scanning apparatuses and image forming portions according to the exemplary embodiment.

FIGS. 1A and 1B illustrate an image forming apparatus that uses an electrophotographic method according to the present exemplary embodiment. Hereunder, the present exemplary embodiment is described by taking a tandem-type color image forming apparatus (color printer) as an example of an image forming apparatus. FIG. 1A is a cross-sectional view of an image forming apparatus. FIG. 1B is an enlarged cross-sectional view of optical scanning apparatuses and image forming portions extracted from FIG. 1A.

An image forming apparatus 100 includes four image forming portions, namely, an image forming portion 81Bk that forms a black image, an image forming portion 81C that forms a cyan image, an image forming portion 81M that forms a magenta image, and an image forming portion 81Y that forms a yellow image that are disposed in a line with a fixed interval between each image forming portion. In FIGS. 1A and 1B, the characters Bk, C, M and Y at the end of the reference symbols correspond to black, cyan, magenta and yellow, respectively. Hereunder, unless particularly required, description of the aforementioned characters Bk, C, M and Y is omitted. A drum type photosensitive member (hereunder, referred to as "photosensitive drum") 82 is arranged in each image forming portion 81. The drum type photosensitive members 82 are image bearing members of the respective image forming portions 81. A primary charging device 83, a developing apparatus 84, a transfer roller 85 and a drum cleaner apparatus 86 are respectively disposed around each photosensitive drum 82. An optical scanning apparatus 50 is disposed below the area between each primary charging device 83 and the corresponding developing apparatus 84.

Black toner, cyan toner, magenta toner and yellow toner are contained in the developing apparatuses 84Bk, 84C, 84M and 84Y, respectively. Each photosensitive drum 82 is a negatively charged OPC photosensitive member and has a photoconductive layer on a drum base made of aluminum, and is rotatively driven at a predetermined process speed in the direction of an arrow (a clockwise direction in FIGS. 1A and 1B) by a driving apparatus (not shown). The primary charging devices 83 uniformly charge the surfaces of the respective photosensitive drums 82 to a predetermined potential of negative polarity by a charging bias applied from a charging bias power source (not shown). Each developing apparatus 84 contains the toner therein and causes the toner of each color to adhere to respective electrostatic latent images formed on the respective photosensitive drums 82 to thereby develop (form a visual image of) each latent image as a toner image. The transfer rollers 85 contact against the respective photosensitive drums 82 through an intermediate transfer belt 87 at respective primary transfer nip portions. Each drum cleaner apparatus 86 has a cleaning blade or the like for removing residual toner that remained on the corresponding photosensitive drum (on the image bearing member) 82 at the time of the primary transfer from the corresponding photosensitive drum 82.

The intermediate transfer belt 87 is suspended around a pair of belt conveying rollers 88 and 89, and is rotated (moved) in the direction of arrow A (counterclockwise direction in FIG. 1A). The intermediate transfer belt 87 is formed of dielectric resin such as polycarbonate, a polyethylene terephthalate resin film, or a polyvinylidene fluoride resin film. The belt conveying roller 88 is in contact with a secondary transfer roller 90 with the intermediate transfer belt 87 interposed therebetween, forming a secondary transfer portion. A belt cleaning apparatus 91 that removes and collects transfer residual toner left on the surface of the intermediate transfer belt 87 is disposed outside the intermediate transfer belt 87 at a position that is near the belt conveying roller 89. A registration detection sensor 71 detects a registration correction pattern of each color that is formed on the intermediate transfer belt 87 to thereby detect a color deviation amount.

Recording media are stored in a paper feed cassette 92. The recording media (hereunder, referred to as "sheets") include paper and OHP sheets. The sheets stored in the paper feed cassette 92 are fed, sheet by sheet, by a paper feed roller 93 and conveyed to a pair of registration rollers 94. When the sheet reaches the pair of registration rollers 94, the conveying operation stops temporarily. The conveying operation is resumed in a manner that adjusts the timing thereof so that toner images are transferred onto a predetermined position of the sheet at the secondary transfer portion. The toner images which were transferred onto the sheet at the secondary transfer portion are fixed to the sheet by heating and pressurization at a fixing device 95. Thereafter, the sheet is conveyed by a pair of conveying rollers 96 and a pair of discharge rollers 97, and discharged onto a discharge tray 98.

[Overview of Optical Scanning Apparatus]

Figure 2A:
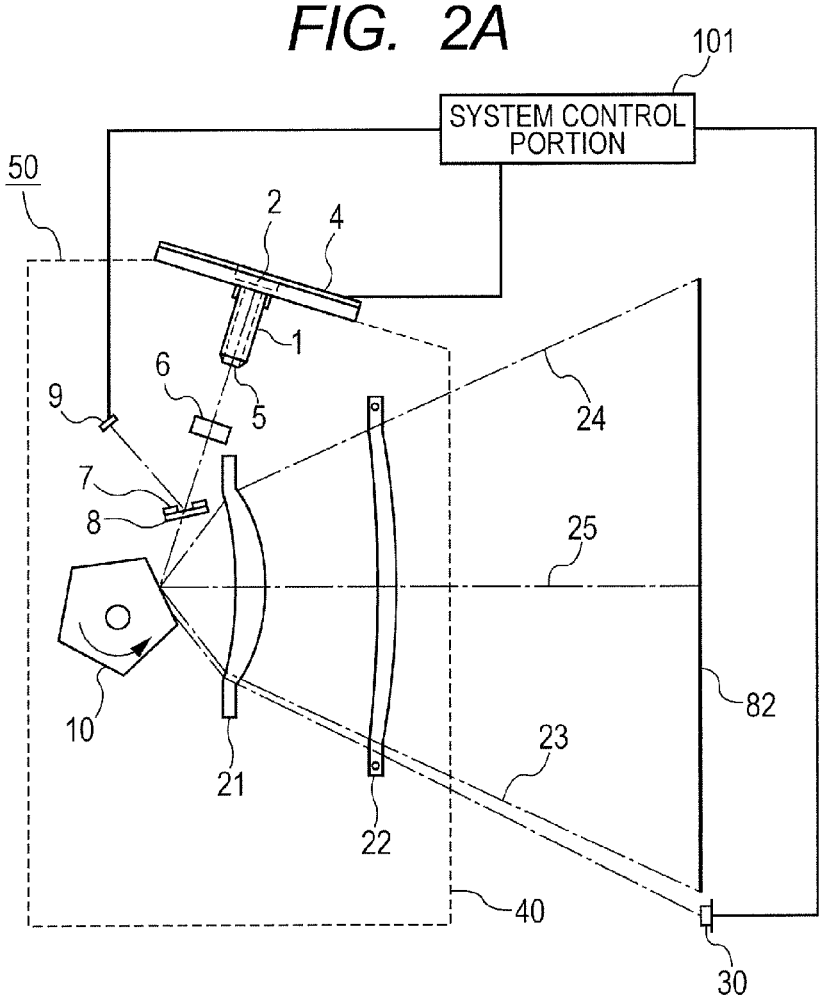
FIG. 2A is a plan view that illustrates the overall configuration of an optical scanning apparatus according to the exemplary embodiment.
Figure 2B:
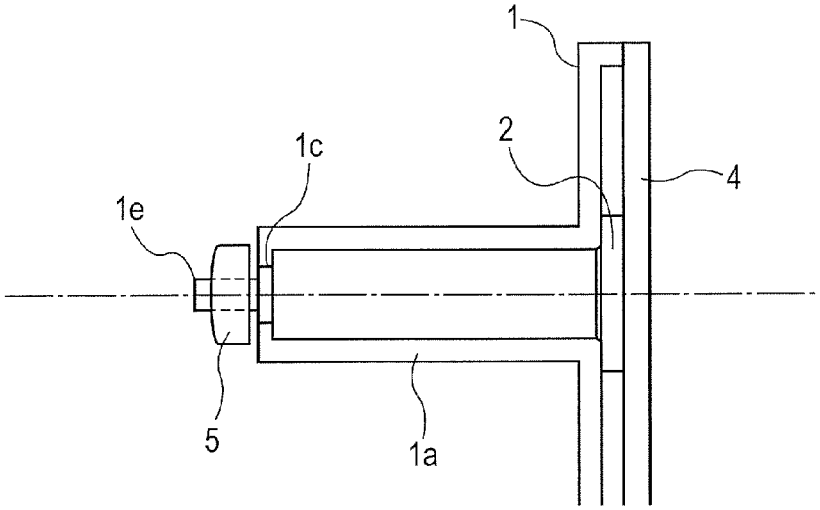
FIG. 2B is a cross-sectional view of an incident optical system according to the exemplary embodiment.

FIGS. 2A and 2B illustrate the optical scanning apparatus 50 of the present exemplary embodiment. FIG. 2A is a plan view that illustrates the overall configuration of the optical scanning apparatus 50. FIG. 2B is a cross-sectional view of an incident optical system. Each optical scanning apparatus 50 performs scanning by a laser beam on the corresponding photosensitive drum 82. The main-scanning direction of the optical scanning apparatus 50 is the longitudinal direction of the photosensitive drum 82 in FIG. 2A, and the sub-scanning direction is the direction perpendicular to the page surface in FIG. 2A.

Next, the configuration of the optical scanning apparatus 50 is described. In FIG. 2B, a laser holder 1 holds a semiconductor laser diode that is a light source, and a VCSEL 2 has a plurality of light emitting points that emit a laser beam. The plurality of light emitting points may be arranged in one line or may be arranged two-dimensionally. An electrical circuit board 4 is electrically connected to the VCSEL 2, and is provided with a laser driving circuit. A sub-scanning aperture portion 1*c* corresponding to the VCSEL 2 is provided at a distal end side of a lens barrel holding portion 1*a*. The sub-scanning aperture portion 1*c* shapes laser beams emitted from the VCSEL 2 into a desired optimal shape in the sub-scanning direction. A collimator lens 5 that converts each luminous flux that passed through the sub-scanning aperture portion 1*c* into substantially parallel luminous flux is provided on an emission side of the sub-scanning aperture portion 1*c*. Two adhesive portions 1*e* are provided on the two sides in the main-scanning direction of the collimator lens 5 in order to fix the collimator lens 5. An irradiation position and a focus of the collimator lens 5 are adjusted while detecting the optical characteristics of the laser beam, and after the position of the collimator lens 5 has been decided, the collimator lens 5 is adhesively fixed to the adhesive portions 1*e* by irradiating ultraviolet light on an ultraviolet-curable adhesive.

In FIG. 2A, a housing 40 (dashed line portion in the drawing) is an optical box that stores the respective optical components of the optical scanning apparatus therein. A fitting hole portion for positioning the laser holder 1 is provided in a side wall of the housing 40. The laser holder 1 is attached to the housing 40 by fitting a fitting portion provided on an external portion of the lens barrel holding portion la into the fitting hole portion. A pitch (interval in the sub-scanning direction) between a plurality of lasers is set so that an interval between laser beams when scanning the photosensitive drum 82 becomes an approximately predetermined value by minimally rotating the laser holder 1.

A cylindrical lens 6 has a predetermined refractive power in the sub-scanning direction, and condenses the parallel luminous flux from the collimator lens 5 into a substantially linear shape. The main-scanning aperture portion 7 shapes the luminous flux transmitted through the cylindrical lens 6 into a desired optimal beam shape in the main-scanning direction. A beam splitter 8 is a beam splitting unit. A laser beam incident on the beam splitter 8 is split into a laser beam (first laser beam) that is reflected by the incident surface of the beam splitter 8, and a laser beam (second laser beam) that passes through the incident surface and is incident on a reflection surface of a rotary polygon mirror 10. A light amount of the first laser beam formed by splitting of the laser beam at the beam splitter 8 is measured by an optical sensor 9 (light-receiving unit) in order to perform APC (auto power control). The optical sensor 9 outputs the measured light amount to a system control portion 101. The system control portion 101 controls a driving current that is supplied to the light emitting points of the VCSEL 2 based on the light amount of the first laser beam measured by the optical sensor 9, to thereby stabilize the light amount of the laser beam emitted from the VCSEL 2. Note that the term "APC" refers to control that, in order to maintain the light amount of a laser beam at a constant amount during a single scanning operation, detects the output of the laser beam in a beam detection section during a single scanning operation and maintains the driving current of the semiconductor laser during the single scanning operation. The APC is executed for the respective light emitting points.

Although according to the present exemplary embodiment a configuration is exemplified in which the first laser beam obtained by splitting of the laser beam by the beam splitter 8 is directly incident on the optical sensor 9, an exemplary embodiment of the present invention is not limited thereto. For example, a configuration may be adopted in which the first laser beam obtained by splitting of the laser beam by the beam splitter 8 is caused to be incident on an optical sensor via a reflection mirror that reflects the first laser beam. In this case, the light-receiving unit is assumed to include the optical sensor and the reflection mirror.

The rotary polygon mirror 10 is rotated at a constant speed in the direction of an arrow (counterclockwise direction) in FIG. 2A by an unshown motor to deflect the second laser beam that has passed through the beam splitter 8. As a result of deflection by the rotary polygon mirror 10, the second laser beam serves as a laser beam that scans the photosensitive drum 82. Further, fθ lenses that include a first imaging lens 21 and a second imaging lens 22 as an imaging optical system are lenses for causing the second laser beam that was reflected by the rotary polygon mirror 10 to scan the surface of the photosensitive drum 82 at a constant speed. The first imaging lens 21 is constituted by a cylindrical lens, and has a refractive power in the main-scanning direction. The second imaging lens 22 corrects an imaging position of the second laser beam in the sub-scanning direction. The first imaging lens 21 and the second imaging lens 22 are formed by molding a resin material such as PC (polycarbonate resin) or PMMA (acrylic resin). Consequently, the lens surface can be formed as an aspheric surface, and deviations in the focus such as curvature of field at a main scanning position on the photosensitive drum 82 can be decreased. The first imaging lens is the nearest lens to the rotary polygon mirror 10 in a plurality of optical elements, which includes the first imaging lens and the second imaging lens, on the optical path of the second laser beam that has been deflected by the rotary polygon mirror 10.

An alternate long and short dash line 23 and an alternate long and short dash line 24 in FIG. 2A show optical paths of the second laser beam that exposes end portions of an image forming region on the photosensitive drum 82. That is, when a laser beam is emitted from the VCSEL 2 in a period of scanning a scanning region that is between the alternate long and short dash line 23 and the alternate long and short dash line 24, the second laser beam arrives at the surface of the photosensitive drum 82. Note that an alternate long and short dash line 25 shows a central axis of the scanning region.

A BD sensor 30 is a synchronization detection unit. The BD sensor 30 is provided outside an exposure region of the photosensitive drum 82 at a substantially conjugate position with respect to the photosensitive drum 82. When the BD sensor 30 receives the second laser beam that is reflected by the rotary polygon mirror 10, the BD sensor 30 outputs a synchronizing signal to the system control portion 101. The system control portion 101 controls the emission timing of laser beams from the VCSEL 2 based on the synchronizing signal from the BD sensor 30.

[Overview of Main-Scanning Aperture Portion and Beam Splitter]

Figure 3A:
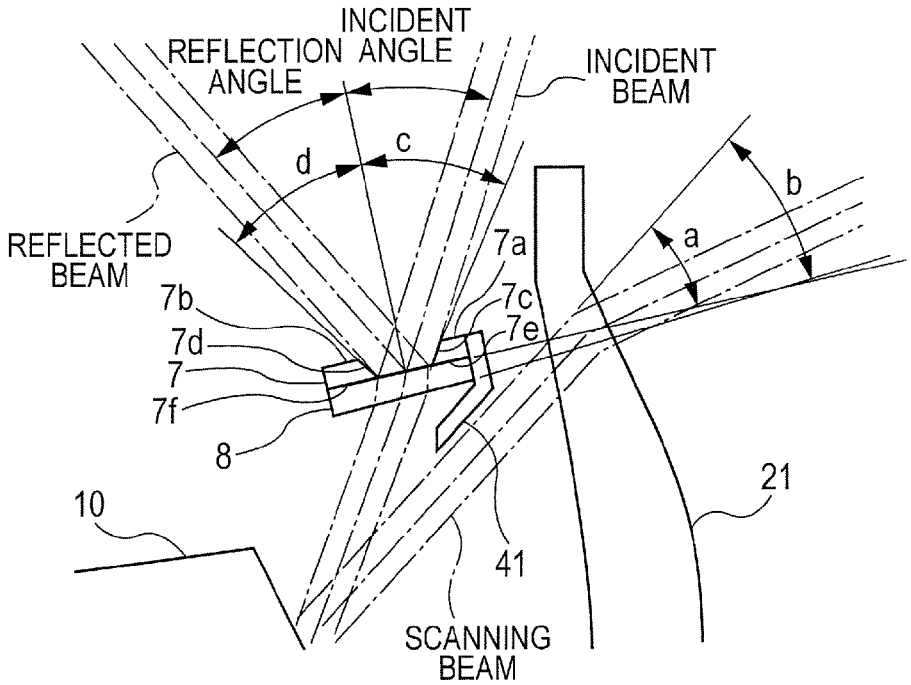
FIGS. 3A and 3B illustrate a main-scanning aperture portion and a beam splitter according to the exemplary embodiment.
Figure 3B:
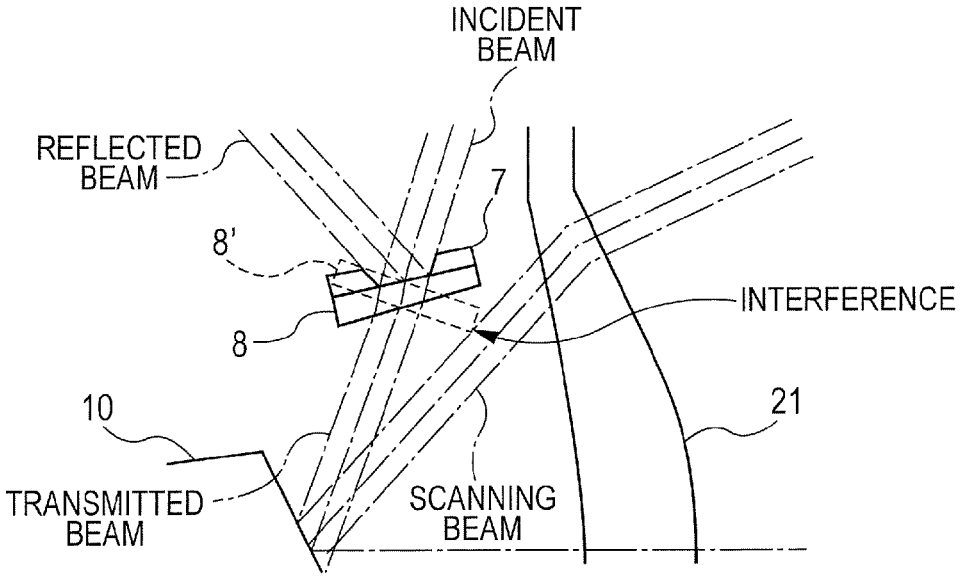
Figure 4:
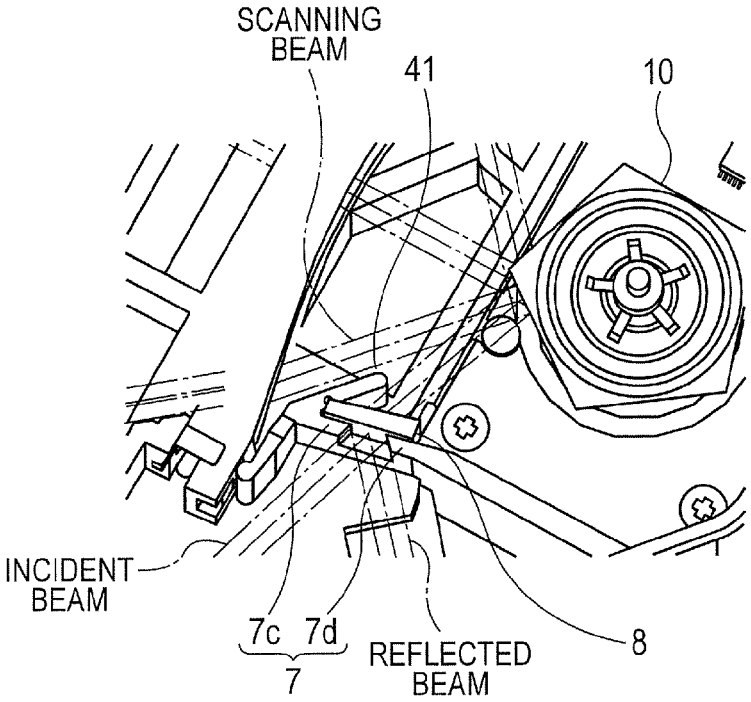
FIG. 4 is an oblique perspective view that illustrates a main-scanning aperture portion and a peripheral portion of a beam splitter according to the exemplary embodiment.

FIGS. 3A and 3B illustrate the main-scanning aperture portion 7 and the beam splitter 8. FIG. 4 is an oblique perspective view that illustrates the main-scanning aperture portion 7 and a peripheral portion of the beam splitter 8 according to the exemplary embodiment. An incident beam illustrated in FIGS. 3A and 3B represents a laser beam that has been emitted from any single light emitting point among the plurality of light emitting points. A relationship between an incident beam and main-scanning adjustment described hereunder holds true with respect to laser beams emitted from all of the light emitting points.

The main-scanning aperture portion 7 includes a first light blocking portion and a second light blocking portion. The first light blocking portion includes an incident side surface 7*b* (first incident side surface) that is on a side on which a laser beam is incident, a facing surface 7*f* (first facing surface) that is a surface on a side from which the second laser beam is emitted and that faces the beam splitter 8 that is described later, and an edge portion 7*d* (first connecting surface) that connects the first incident side surface 7*b* and the facing surface 7*f*. The second light blocking portion includes an incident side surface 7*a* (second incident side surface) that is on a side on which a laser beam is incident, a facing surface 7*e* (second facing surface) that is a surface on a side from which the second laser beam is emitted and that faces the beam splitter 8 that is described later, and an edge portion 7*c* (second connecting surface) that connects the second incident side surface 7*a* and the facing surface 7*e*.

In FIG. 3A, the main-scanning aperture portion 7 is an opening portion that has the edge portion 7*c* having an angle c that is wider than an incident angle of a laser beam (incident beam) on the beam splitter 8, and the edge portion 7*d* having an angle d that is wider than a reflection angle of a laser beam (reflected beam) with respect to the beam splitter 8. The angles c and d represent angles with respect to a normal line direction of the incident surface of the beam splitter 8. The main-scanning aperture portion 7 performs main-scanning adjustment that, with respect to luminous flux that passed through the cylindrical lens 6, limits a luminous flux width between the edge distal ends of the edge portion 7*c* and the edge portion 7*d*. The beam splitter 8 is mounted in a condition in which the beam splitter 8 abuts against the main-scanning aperture portion 7. Specifically, the beam splitter 8 contacts the facing surface 7*f* and the facing surface 7*d*. By contacting the facing surface 7*f* and the facing surface 7*d*, the beam splitter 8 is precisely positioned inside the optical box. Shaping of a laser beam is performed by passing the laser beam through a gap that is formed by a ridge line between the facing surface 7*f* that contacts with the incident surface of the beam splitter 8 and the connecting surface 7*b* and a ridge line between the facing surface 7*e* and the connecting surface 7*a*. Therefore, an incident beam on the beam splitter 8 can be split with high accuracy into a reflected beam at the incident surface of the beam splitter 8 and a transmitted beam that is transmitted to the emission surface. As a result, even if the system control portion 101 changes the driving current of the respective lasers, a ratio between a light amount that passes through the beam splitter 8 and exposes the photosensitive drum 82 and a light amount that is reflected by the beam splitter 8 and is guided to the optical sensor 9 is fixed, and light amount measurement and light amount control can be performed with high accuracy.

Since an incident beam on the beam splitter 8 is completely reflected when an incident angle of the incident beam is greater than or equal to approximately 42° (degrees), according to the present exemplary embodiment, for example, a configuration is adopted in which the incident angle is less than or equal to 40°, and the angles c and d of the edge portions 7*c* and 7*d* of the main-scanning aperture portion 7 are 45°. The housing 40 of the present exemplary embodiment is formed by injection molding in which pressure is applied to inject fluidized resin into a metal mold to perform molding, and the main-scanning aperture portion 7 is formed integrally with the housing. Therefore, if the angles c and d of the edge portions 7*c* and 7*d* are too large, the edge distal end portions of the edge portion 7*c* and the edge portion 7*d* become narrow, and in some cases the resin forming the housing does not spread as far as the edge distal end portions when performing injection molding of the housing 40. As a result, in some cases projections and depressions arise at the edge distal end portions, and sufficient accuracy is not obtained with respect to the main-scanning adjustment. Therefore, it is appropriate to make the angles c and d less than or equal to 45°.

If the beam splitter 8 is disposed as illustrated by a beam splitter 8' that is shown by a dashed line in FIG. 3B that does not take into account an angle in the main-scanning direction of scanning beams deflected by the rotary polygon mirror 10, there is a risk that the beam splitter 8' will interfere with a scanning beam and obstruct the scanning beam. Therefore, as shown in FIG. 3A, the beam splitter 8 is disposed so as to incline in a direction that does not block a scanning beam that exposes an endmost portion of the image region on the photosensitive drum 82. It is thereby possible to dispose the main-scanning aperture portion 7 that abuts against the beam splitter 8 adjacent to the rotary polygon mirror 10, and to reduce the occurrence of main scanning jitter. In FIG. 3A, an angle formed by a scanning beam that exposes an endmost portion of an image region on the photosensitive drum 82 and the incident surface of the beam splitter 8 is an angle a, and an angle formed by the aforementioned scanning beam and the emission surface of the beam splitter 8 is an angle b. The angle a is larger than the angle b. Since the angle a is larger than the angle b, the incident surface and the emission surface of the beam splitter 8 are not parallel, and a distance (width) between the incident surface and the emission surface of the beam splitter 8 is smaller (narrower) at an end portion on a side near the first imaging lens 21 (side near the scanning beam) compared to an end portion on the opposite side. By narrowing the width of the end portion of the beam splitter on the side near to the first imaging lens 21, it is possible to dispose the beam splitter 8 closer to the rotary polygon mirror 10 without the beam splitter 8 interfering with a scanning beam. As a result, the main-scanning aperture portion 7 that abuts against the beam splitter 8 can also be disposed close to the rotary polygon mirror 10, and hence the occurrence of main scanning jitter can be reduced.

Even if a laser beam that passed through the incident surface of the beam splitter 8 is reflected at the inner face side of the emission surface of the beam splitter 8, since the incident surface and the emission surface of the beam splitter 8 are not parallel, the reflection angles at the incident surface and the emission surface are different. Consequently, since a reflected beam that is reflected at the emission surface of the beam splitter 8 is not incident on the optical sensor 9, the optical sensor 9 can detect a reflected beam that is reflected at the incident surface of the beam splitter 8 and can perform light amount detection with high accuracy.

As shown in FIG. 3A, the main-scanning aperture portion 7 is disposed between a scanning region of the second laser beam between the rotary polygon mirror 10 and the first imaging lens 21, and the optical sensor 9. An abutting rib 41 (abutting portion) is provided so as to be parallel with a scanning beam that exposes an endmost portion of the image region. The abutting rib 41 is provided as a light blocking portion for preventing a scanning beam that scans the outside of an image region at an endmost portion on the photosensitive drum 82 from interfering with the beam splitter 8. That is, the abutting rib 41 defines the position of the beam splitter 8 in a direction along the facing surface 7*f* and the facing surface 7*e*. The beam splitter 8 is positioned by abutment of the end portion of the beam splitter 8 against the abutting rib 41. Further, to ensure that a reflected beam formed by reflection of a scanning beam at a portion of the beam splitter 8 does not become ghost light that reaches the image region on the photosensitive drum 82 and forms a ghost image, the abutting rib 41 blocks the reflected beam so that the reflected beam does not advance towards the image region on the photosensitive drum 82. FIG. 4 is an oblique perspective view that illustrates the main-scanning aperture portion 7, the beam splitter 8 and the abutting rib 41 in the housing 40 of the present exemplary embodiment. As shown in FIG. 4, the abutting rib 41 is an integrated rib that is formed continuously with the main-scanning aperture portion 7 in the housing 40, and also serves as an abutment at the side surface (main-scanning direction) of the beam splitter 8. The main-scanning aperture portion 7 is a rib that is formed continuously with the abutting rib 41 in the housing 40, and this configuration achieves a reduction in the number of components and lowers costs. An angle of the beam splitter with respect to a scanning beam differs between the incident surface side and the emission surface side thereof, and the thickness of the beam splitter also varies in the main-scanning direction. Consequently, if the position at which the beam splitter 8 is installed in the main-scanning direction deviates, a position on the emission surface of the beam splitter 8 of a transmitted beam that is irradiated at the rotary polygon mirror 10 will also change in the main-scanning direction, a deflected light point position on the rotary polygon mirror 10 will also change, and a position in the main-scanning direction of imaging on the photosensitive drum 82 will also deviate. Therefore, by providing the abutting rib 41 that serves to block light and also as an abutment in the main-scanning direction in the housing 40, the focusing direction of the beam splitter and the accuracy with which the beam splitter 8 is mounted in the main-scanning direction can be improved and, furthermore, the number of components can be reduced and miniaturization and a reduction in costs can be realized.

As shown in FIG. 2A, the BD sensor 30 is disposed outside the image region on an end portion side that is on the opposite side to the end portion side of the photosensitive drum 82 that is close to the position at which the beam splitter 8 is arranged. It is thereby possible to prevent interference between the beam splitter 8 and luminous flux (a scanning beam) received by the BD sensor 30, and to dispose the main-scanning aperture portion 7, which abuts against the beam splitter 8, close to the rotary polygon mirror 10.

[Overview of APC]

Figure 5:
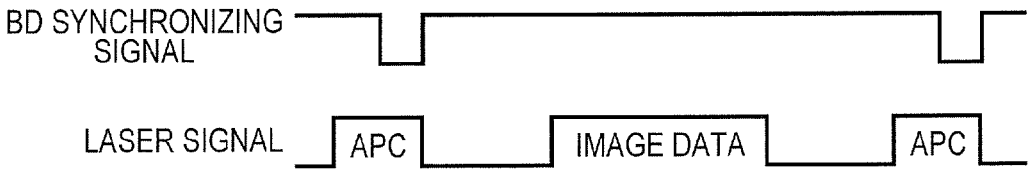
FIG. 5 is a timing chart that illustrates a relationship between a laser signal and a BD synchronizing signal according to the exemplary embodiment.
Figure 6:
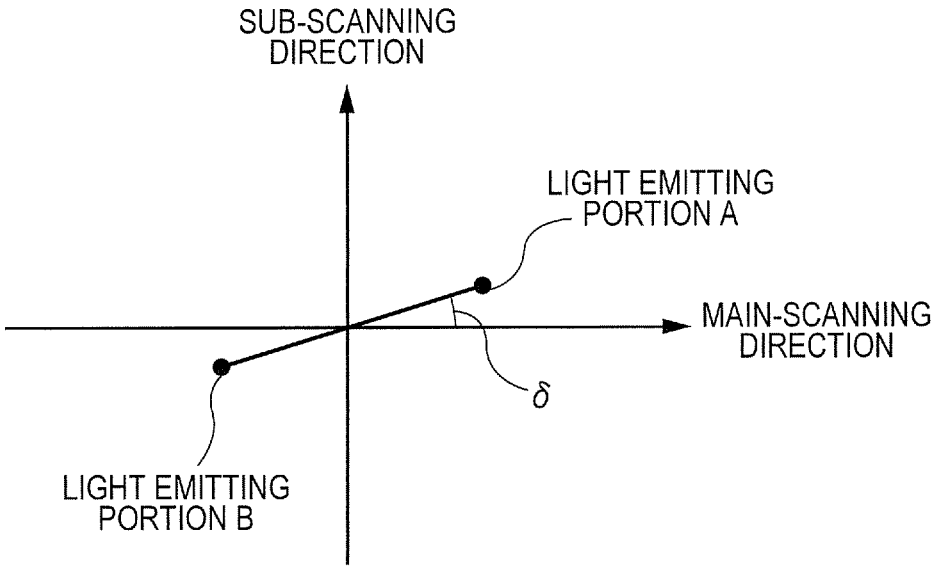
FIG. 6 illustrates a configuration example of a multi-beam scanning system according to a conventional example.
Figure 7A:
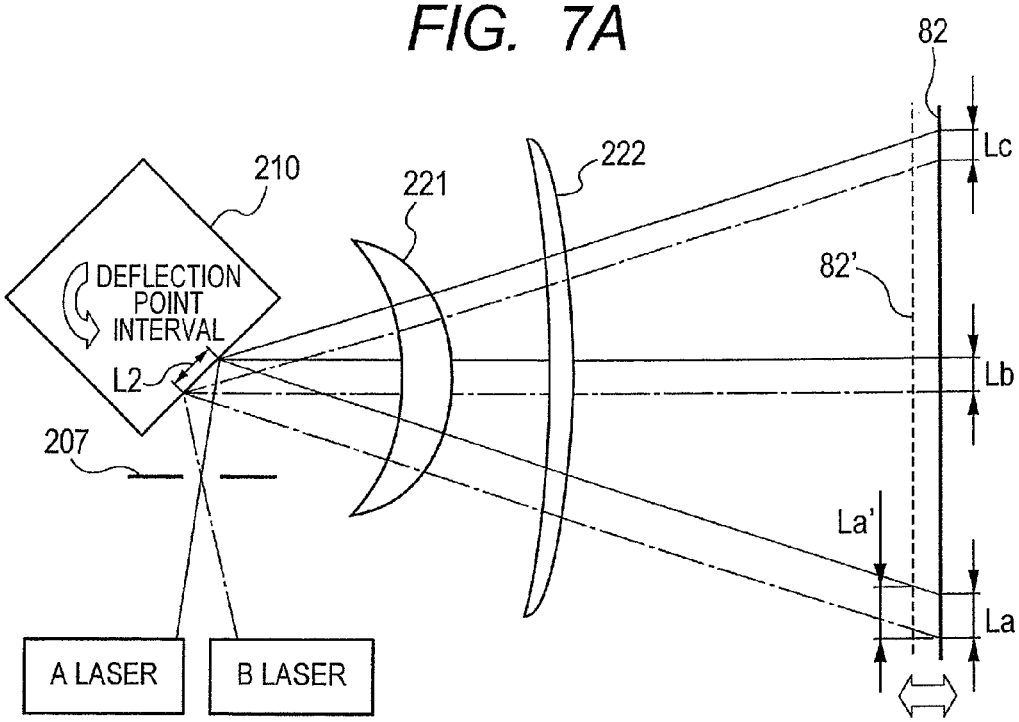
FIG. 7A illustrates main scanning jitter according to a conventional example.
Figure 7B:
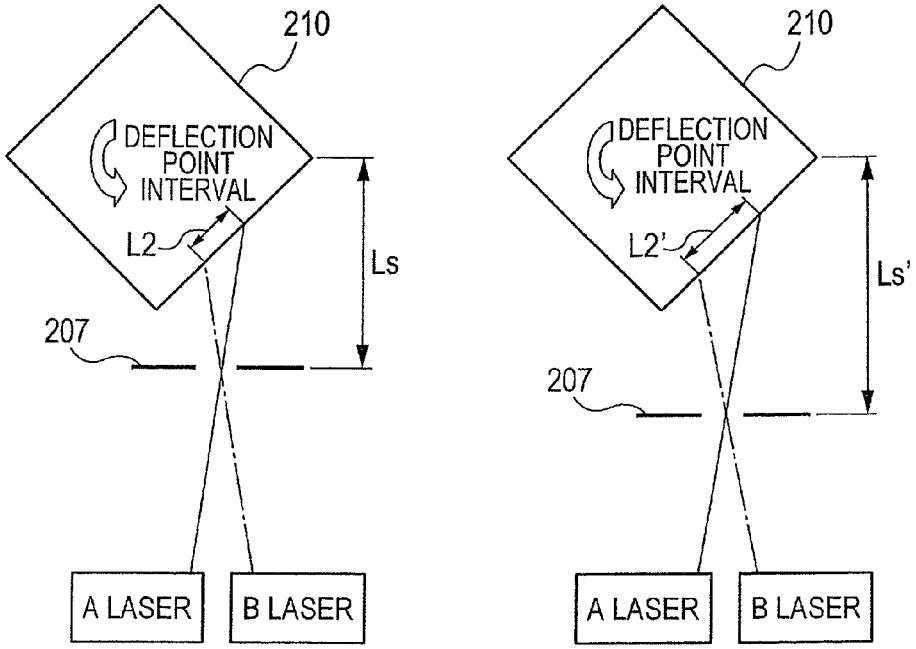
FIG. 7B illustrates a relationship between the position of an aperture and a deflection point interval according to a conventional example.

FIG. 5 is a timing chart that illustrates the relationship between a laser signal emitted from a surface emitting laser 2 and a BD synchronizing signal that the BD sensor 30 outputs to the system control portion 101 upon detection of a scanning beam that was reflected by the rotary polygon mirror 10 according to the present exemplary embodiment. In accordance with a control instruction from the system control portion 101, the surface emitting laser 2 emits a laser signal that corresponds with image data to thereby expose an electrostatic latent image on the photosensitive drum 82. After scanning of an image region of the photosensitive drum 82 is completed, in order to perform APC, the system control portion 101 drives the surface emitting laser 2 using a predetermined current value to emit a laser signal, and measures the light amount of the laser signal at that time using the optical sensor 9. According to the present exemplary embodiment, the main-scanning aperture portion 7 abuts against the beam splitter 8, so that main-scanning adjustment is performed at the incident surface of the beam splitter 8. An incident beam on the beam splitter 8 for which main-scanning adjustment has been performed is split with high accuracy into a reflected beam that is guided to the optical sensor 9 and a transmitted beam that is transmitted to the emission surface of the beam splitter 8. As a result, detection of a light amount of the reflected beam can be performed with high accuracy at the optical sensor 9. At approximately the same time as completion of the operation to measure the light amount by the optical sensor 9, the laser signal that was emitted from the surface emitting laser 2 is detected by the BD sensor 30, and the BD sensor 30 outputs a BD synchronizing signal to the system control portion 101. By performing the detection of a laser signal by the BD sensor 30 at a timing at which light amount detection for APC is completed, simultaneous detection of stable light amounts can be performed for each scanning operation, and detection errors that accompany light amount fluctuations can be suppressed to the minimum.

[Exposure of Photosensitive Drum]

Next, the flow of the process until luminous flux emitted from the surface emitting laser 2 by the optical scanning apparatus 50Bk is exposed as a scanning beam E1 on the photosensitive drum is described using FIGS. 2A and 2B. When luminous flux is emitted from the surface emitting laser 2, the size of a sub-scanning cross section of the emitted luminous flux is limited by the sub-scanning aperture portion 1*c* of the laser holder 1, the luminous flux is converted into substantially parallel luminous flux by the collimator lens 5, and is thereafter incident on a lens portion of the cylindrical lens 6. The luminous flux incident on the cylindrical lens 6 is transmitted in a state in which the luminous flux maintains the original state thereof within the main-scanning cross section, and is converged within the sub-scanning cross section so as to be imaged as a substantially linear image on the rotary polygon mirror 10.

Next, the size of the main-scanning cross section of the luminous flux is limited by the main-scanning aperture portion 7 so that the luminous flux is shaped to have a predetermined beam diameter on the photosensitive drum 82Bk, and one portion of the luminous flux is reflected at the incident surface side of the beam splitter and is incident on the optical sensor 9. The second laser beam that passed through the beam splitter 8 is deflected by the rotary polygon mirror 10. After the second laser beam that has been deflected by the rotary polygon mirror 10 passes through the first imaging lens 21, the second laser beam passes through the second imaging lens 22 and is exposed as the scanning beam E1 on the photosensitive drum 82Bk. The BD sensor 30 detects the second laser beam emitted from the surface emitting laser 2, and outputs a BD synchronizing signal to the system control portion 101. Based on the BD synchronizing signal from the BD sensor 30, the system control portion 101 adjusts a timing with respect to a position for starting scanning at an image end portion by the surface emitting laser 2. According to the present exemplary embodiment, the beam splitter 8 can be disposed close to the rotary polygon mirror 10 without interfering with the scanning beam. Consequently, it is possible to also dispose the main-scanning aperture portion 7 that abuts against the beam splitter 8 close to the rotary polygon mirror 10, and the occurrence of main scanning jitter can be reduced. The optical scanning apparatuses 50C, 50M and 50Y have the same configuration as the optical scanning apparatus 50Bk, and the respective laser beam emitted therefrom are exposed as scanning beams E2, E3 and E4 on the photosensitive drums 82C, 82M and 82Y, respectively.

[Overview of Image Formation Operations]

Next, operations when performing image formation with the image forming apparatus 100 are described. If a signal to start printing is inputted to a control portion (not shown) of the image forming apparatus 100, the respective optical scanning apparatuses 50 emit laser luminous flux based on image information, and each emitted laser luminous flux is irradiated as a scanning beam E onto the surface of the corresponding photosensitive drum 82 to thereby expose the photosensitive drum 82.

The respective photosensitive drums 82 that have been uniformly charged by the corresponding primary charging devices 83 are exposed by the corresponding optical scanning apparatuses 50 to thereby form an electrostatic latent image on each of the photosensitive drums 82. Developing rollers of each of the developing apparatus 84 cause toner of each color within the respective developing apparatuses 84 to adhere to the electrostatic latent images to form toner images of each color on the respective photosensitive drums 82. The toner images of each color on the respective photosensitive drums 82 are transferred onto the intermediate transfer belt 87 at the primary transfer nip portion and thereby superimposed on each other. One sheet at a time is fed from the paper feed cassette 92 by the paper feed roller 93. When the sheet is conveyed to the pair of registration rollers 94, conveying of the sheet stops temporarily. The pair of registration rollers 94 resume conveying of the sheet in a manner that adjusts the timing thereof relative to the toner images on the intermediate transfer belt 87 so that the toner images are transferred onto a predetermined position on the sheet at the secondary transfer portion. At the secondary transfer portion, the toner images on the intermediate transfer belt 87 are transferred onto the sheet. The sheet onto which the toner images have been transferred is conveyed to the fixing device 95. At the fixing device 95, the toner images on the sheet are fixed to the sheet by heating and pressurization. The sheet to which the toner images have been fixed is conveyed by the pair of conveying rollers 96 and the pair of discharge rollers 97, and discharged onto the discharge tray 98. According to the present exemplary embodiment, the beam splitter 8 can be disposed close to the rotary polygon mirror 10 without interfering with a scanning beam, and it is also possible for the main-scanning aperture portion 7 that abuts against the beam splitter 8 to be disposed close to the rotary polygon mirror 10. As a result, main scanning jitter can be reduced and highly accurate image formation can be performed.

As described above, according to the present exemplary embodiment, main scanning jitter can be reduced with a simple configuration, and highly accurate light amount control can be performed. More specifically, by narrowing the width of the end portion of the beam splitter on a side that is near to a scanning beam, the beam splitter can be disposed closer to the rotary polygon mirror without interfering with the scanning beam. As a result, the main-scanning aperture portion that abuts against the beam splitter can also be disposed close to the rotary polygon mirror and the occurrence of main scanning jitter can be reduced. In addition, since the main-scanning aperture portion is mounted in contact with the beam splitter, main-scanning adjustment is performed at the incident surface of the beam splitter. Therefore, an incident beam on the beam splitter can be split with high accuracy into a reflected beam that is reflected by the incident surface of the beam splitter and guided to an optical sensor, and a transmitted beam that is transmitted to an emission surface of the beam splitter. It is thus possible to detect a light amount with high accuracy at the optical sensor. As a result, even if the driving currents of respective lasers are changed, a ratio between a light amount that passes through the beam splitter and exposes the photosensitive drum and a light amount that is reflected by the beam splitter and guided to the optical sensor is fixed, and light amount measurement and light amount control can be performed with high accuracy.

The smaller that an angle that is formed between a scanning beam that exposes an endmost portion of the image region on the photosensitive drum and the emission surface of the beam splitter is, the closer to the rotary polygon mirror that the main-scanning aperture portion and the beam splitter can be disposed without interfering with the scanning beam, and the greater the extent to which the occurrence of main scanning jitter can be reduced. In addition, the angle can be made smaller by changing the configuration in the following manner based on the relationship between incident and exit angles with respect to the beam splitter that does not totally reflect incident light. That is, for example, the angle can be made smaller by decreasing the number of surfaces of the rotary polygon mirror to thereby increase the scanning angle as far as an end portion of an image region of a photosensitive drum or, without changing the number of surfaces of the rotary polygon mirror, by increasing the distance from the rotary polygon mirror to the photosensitive drum to thereby decrease the scanning angle to the image region end portion.

[Other Exemplary Embodiment]

According to the present exemplary embodiment, a configuration is adopted in which an aperture is separated into the sub-scanning aperture portion 1*c* and the main-scanning aperture portion 7. However, a configuration may also be adopted in which an integral opening portion is disposed immediately anterior to the beam splitter 8. In this case, if it is attempted to form an aperture portion that is the integral opening portion using a rib of the housing 40, the adopted configuration will be a slide-type configuration. The aperture portion may also be formed using a metal plate or the like, and not a rib of the housing 40.

As described above, according to another exemplary embodiment, main scanning jitter can be reduced with a simple configuration, and highly accurate light amount control can be performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2012-100095, filed Apr. 25, 2012, and No. 2013-058260, filed Mar. 21, 2013, which are hereby incorporated by reference herein in their entirety.

What is claimed is:

1. An image forming apparatus, comprising:

a light source configured to emit a laser beam;

an aperture configured to shape the laser beam that is emitted from the light source;

a beam splitter configured to split the laser beam, which is shaped by the aperture, into a first laser beam that is a reflected beam and a second laser beam that is a transmitted beam, wherein the beam splitter is positioned by contacting to the aperture, and wherein the first laser beam is reflected for incidence on a light-receiving unit;

a deflection unit configured to deflect the second laser beam so that the deflected second laser beam scans a photosensitive member;

a lens configured to guide the second laser beam deflected by the deflection unit to the photosensitive member, wherein the lens is disposed at a closest position to the deflection unit in a plurality of optical elements, which includes the lens, on an optical path of the second laser beam deflected by the deflection unit;

an optical box in which the light source, the aperture, the beam splitter, the light-receiving unit, the deflection unit, and the lens are disposed; and a control unit configured to control a light amount of the laser beam that the light source emits based on a light amount of the first laser beam received by the light-receiving unit;

wherein the aperture and the beam splitter are disposed between an optical axis of the lens and an end of the lens on a side where the light source is disposed, in a longitudinal direction of the lens, and wherein the aperture defines a position of the beam splitter relative to the optical box so that the beam splitter is prevented from blocking the second laser beam deflected by the deflection unit for incidence on the lens and so that an extension line, which overlaps an optical path of the first laser beam reflected by the beam splitter and which extends toward a side of the beam splitter, intersects with the lens.

2. The image forming apparatus according to claim 1, wherein:

the aperture has an incident side surface on which the laser beam emitted from the light source is incident, a facing surface that faces the beam splitter, and a connecting surface that connects the incident side surface and the facing surface; and the first laser beam reflected by an incident surface of the beam splitter is emitted from the incident side surface side of the aperture and is incident on the light-receiving unit.

3. The image forming apparatus according to claim 2, wherein an angle formed by the connecting surface on a side on which the light-receiving unit is disposed relative to a central axis of the laser beam that is emitted from the light source and a normal line of the incident surface of the beam splitter is larger than an incident angle of the laser beam that is emitted from the light source to the incident surface of the beam splitter.

4. The image forming apparatus according to claim 2, wherein an angle formed by the connecting surface on an opposite side to a side on which the light-receiving unit is disposed relative to a central axis of the laser beam that is emitted from the light source and a normal line of the incident surface of the beam splitter is larger than an incident angle of the laser beam that is emitted from the light source to the incident surface of the beam splitter.

5. The image forming apparatus according to claim 2, wherein the second laser beam is a laser beam that passes through a gap formed by the facing surface, and the beam splitter.

6. The image forming apparatus according to claim 2, wherein the beam splitter is in contact with the facing surface.

7. The image forming apparatus according to claim 1, wherein the aperture has:

a first light blocking portion which includes a first incident side surface on a side on which the laser beam that is emitted from the light source is incident, a first facing surface that faces the beam splitter, and a first connecting surface that connects the first incident side surface and the first facing face, and which is disposed on the light-receiving unit side with respect to a central axis of the laser beam that is emitted from the light source; and a second light blocking portion which includes a second incident side surface on a side on which the laser beam that is emitted from the light source is incident, a second facing surface that faces the beam splitter, and a second connecting surface that connects the second incident side surface and the second facing surface, and which is disposed on an opposite side to a side on which the light-receiving unit side is disposed with respect to the central axis of the laser beam that is emitted from the light source.

8. The image forming apparatus according to claim 7, wherein an angle formed by the first connecting surface and a normal line of an incident surface of the beam splitter is larger than an incident angle of the laser beam that is emitted from the light source to the incident surface of the beam splitter.

9. The image forming apparatus according to claim 8, wherein an angle formed by the second connecting surface and the normal line of the incident surface of the beam splitter is larger than an incident angle of the laser beam that is emitted from the light source to the incident surface of the beam splitter.

10. The image forming apparatus according to claim 7, wherein the second laser beam is a laser beam that passes through a gap formed by the first facing surface and the second facing surface, and the beam splitter.

11. The image forming apparatus according to claim 7, wherein the beam splitter is in contact with the first facing surface.

12. The image forming apparatus according to claim 7, further comprising an abutting portion against which the beam splitter abuts in a direction along the first facing surface and the second facing surface, wherein the abutting portion is provided between a scanning region of the second laser beam that is deflected by the deflection unit between the deflection unit and the lens, and the aperture.

13. The image forming apparatus according to claim 12, wherein the abutting portion is connected to the second light blocking portion.

14. The image forming apparatus according to claim 1, wherein the light source is a vertical cavity surface emitting laser.

15. The image forming apparatus according to claim 1, further comprising a blocking portion provided on the extension line between the beam splitter and the lens so as to prevent from blocking the second laser beam deflected by the deflection unit and to be incident on the lens.

16. The image forming apparatus according to claim 1, wherein the aperture is provided between a scanning region and the lens, wherein the scanning region is a region between the deflection unit and the lens in which the second laser beam is deflected by the deflection unit.

17. An optical scanning apparatus including a light-receiving unit and attached to an image forming apparatus including a control unit configured to control a light amount of a laser beam based on a light amount of a laser beam received by the light-receiving unit, the optical scanning apparatus comprising:

a light source configured to emit the laser beam;

an aperture configured to shape the laser beam that is emitted from the light source;

a beam splitter configured to split the laser beam, which is shaped by the aperture, into a first laser beam that is a reflected beam and a second laser beam that is a transmitted beam, wherein the beam splitter is positioned by contacting to the aperture, and wherein the first laser beam is reflected for incidence on the light-receiving unit;

a deflection unit configured to deflect the second laser beam so that the deflected second laser beam scans a photosensitive member;

a lens configured to guide the second laser beam deflected by the deflection unit to the photosensitive member, wherein the lens is disposed at a closest position to the deflection unit in a plurality of optical elements, which includes the lens, on an optical path of the second laser beam deflected by the deflection unit; and an optical box in which the light source, the aperture, the beam splitter, the light-receiving unit, the deflection unit, and the lens are disposed;

wherein the control unit is configured to control the light amount of the laser beam that the light source emits based on the light amount of the first laser beam received by the light-receiving unit, wherein the aperture and the beam splitter are disposed between an optical axis of the lens and an end of the lens on a side where the light source is disposed, in a longitudinal direction of the lens, and wherein the aperture defines a position of the beam splitter relative to the optical box so that the beam splitter is prevented from blocking the second laser beam deflected by the deflection unit for incidence on the lens and so that an extension line, which overlaps an optical path of the first laser beam reflected by the beam splitter and which extends toward a side of the beam splitter, intersects with the lens.

18. The optical scanning apparatus according to claim 17, further comprising a blocking portion provided on the extension line between the beam splitter and the lens so as to prevent from blocking the second laser beam deflected by the deflection unit and to be incident on the lens.

19. The optical scanning apparatus according to claim 17, wherein the aperture is provided between a scanning region and the lens, wherein the scanning region is a region between the deflection unit and the lens in which the second laser beam is deflected by the deflection unit.

* * * * *